US006670108B1

(12) United States Patent
Schmittou

(10) Patent No.: US 6,670,108 B1
(45) Date of Patent: Dec. 30, 2003

(54) METHOD OF PROCESSING SILVER HALIDE COLOR PHOTOGRAPHIC MATERIALS

(75) Inventor: Eric R. Schmittou, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/324,567

(22) Filed: Dec. 19, 2002

(51) Int. Cl.[7] ..... G03C 7/42
(52) U.S. Cl. ..... 430/393; 430/403; 430/427
(58) Field of Search ..... 430/393, 403, 430/427

(56) References Cited

PUBLICATIONS

U.S. application Ser. No. 09/920,495 of Twist et al filed Aug. 1, 2001 "Processing Photographic Material".
U.S. application Ser. No. 10/012,673 of Twist filed Oct. 30, 2001 "Processing Photographic Material".
U.S. application Ser. No. 10/051,074 of Hall et al filed Jan. 30, 2002 "System and Method for Processing Photographic Film Images".

*Primary Examiner*—Hoa Van Le
(74) *Attorney, Agent, or Firm*—Sarah Meeks Roberts

(57) ABSTRACT

This invention relates to a method for processing a silver halide color photographic material comprising the steps of loading the material into a chamber adapted to hold the material therein; introducing a measured amount of a color developer solution into the chamber; developing the photographic material with the color developer solution; introducing into the chamber a measured amount of a processing solution which arrests development, without removing the color developer solution, to form a developer/stop solution mixture; processing the photographic material with the developer/stop solution mixture, substantially removing all of the developer/stop mixture solution from the chamber; then providing in the chamber a bleach/fixer solution mixture comprising a bleaching agent and a fixing agent; and processing the photographic material with the bleach/fixer solution mixture; wherein the color developer solution is utilized in the amount of greater than or equal to 375 ml/m$^2$ of the photographic material that is processed; and wherein the total volume of solution or solution mixture for each processing stage is spread over the whole area of the photographic material in a repetitive manner to enable uniform processing.

39 Claims, 1 Drawing Sheet

METHOD OF PROCESSING SILVER HALIDE COLOR PHOTOGRAPHIC MATERIALS

FIELD OF THE INVENTION

This invention relates to a method of processing a silver halide photographic element. It particularly relates to the rapid processing of a photographic element in a single processing chamber.

BACKGROUND OF THE INVENTION

Conventional processing of photographic material requires the use of large tanks of processing solutions. Each tank contains a processing solution such as developer, bleach, fixing solution, or washing solution. The material is transported through each tank in turn, typically in a sinusoidal manner. There is a tendency for the solutions to carry over from one tank to another leading to pollution of the solutions. Conventional processing has several other drawbacks. The temperatures which can be utilized are limited and, therefore, the process is slow. The composition of the solutions must be stable over long time periods in the processing tanks. Replenishment of the solutions is difficult to control. The processing apparatus is also very large due to the number of processing tanks.

In color negative film processing carried out in small continuous processors or "minilabs" the film passes through each stage of the process and from one tank of processing solution to the next tank of processing solution in a sinusoidal manner. The processing tanks used in a "minilab" processor are usually within the range of 3 to 20 litres volume for each tank depending on the individual design. In Process C-41SM the developer stage has one tank, the bleach stage has one tank, the fixer stage consists of two tanks, and the stabilizer stage consists of three tanks. This gives the total number of tanks as seven. It can be seen that each processing solution is in at least one separate tank, and the film passes sequentially through these tanks. The amounts of processing solution used in a minilab vary with the type of solution and processor, but a developer replenishment rate is generally about 375–500 mL/m$^2$, a bleach replenishment rate is about 130 mL/m$^2$, a fixer replenishment rate is about 200–900 mL/m$^2$, and a rinse or stabilizer replenishment rate is about 775–1000 mL/m$^2$.

A method of processing photographic material in a single processing chamber is described in U.S. application Ser. No. 09/920,495 of Twist et al filed Aug. 1, 2001. One of the advantages of the process is that small volumes of processing solutions are used per unit surface area of the photographic material that is processed (9.4 to 1900 mL/m$^2$). Examples of the process include the sequential application and removal of developer+stop, bleach, fixer, and rinse solutions from the processing chamber. A rapid process example applies developer solution at 280 mL/m$^2$ and stop, bleach, and fixer solutions each at 375 ml/m$^2$.

A compact processing method that comprises the sequential addition to a processing chamber of a first processing solution (for example, a developer, fixer, or bleach solution) to process the material and then a second processing solution (for example, a stop, fixer, bleach, or bleach-fixer solution) to process the material further without removing the first processing solution has been disclosed in U.S. application Ser. No. 10/012673 of Twist filed Oct. 30, 2001. Such a process is referred to hereafter as a merged process. In a preferred version of the method a developer solution is first added to the chamber to develop the material. Then, a fixer solution is added to the developer solution within the chamber for the purpose of stopping development and initiating fixing. Subsequent to this, a bleaching agent solution is added to the developer/fixer mixture within the chamber to bleach developed silver and complete the fixing of the material. Again, low volumes of processing solutions are applied. For color negative film processing, the first processing solution of the method is applied at 50 to 2850 mL/m$^2$, and the second and subsequent processing solutions are applied at 6 to 2000 mL/m$^2$. Highly concentrated processing solutions can be used.

Useful concentrations of fixing agents and bleaching agents in rapid versions of such a merged processing method for color negative films have been disclosed, for example, in U.S. application Ser. No.10/012,673 of Twist filed Oct. 30, 2001 and U.S. application Ser. No. 10/051,074 of Hall et al filed Jan. 30, 2002. Fixing agent concentrations (thiosulfate is preferred, and ammonium thiosulfate is more preferred as a fixing agent for rapid fixing) above 0.5 mol/L are useful in processing solution mixtures of the method. The fixing agents should be preferably at a total concentration from about 0.75 mol/L to about 2.0 mol/L in processing solution mixtures of the method in order to process rapidly without costly, wasteful use of fixer. The preferred Fe(III)chelate bleaching agents should be at a total concentration from about 0.09 equivalents/L to about 0.6 equivalents/L in the processing solution mixtures of the method in order to process rapidly without costly, wasteful use of bleaching agent. A more preferred Fe(III)chelate bleaching agent concentration is from about 0.12 equivalents/L to about 0.6 equivalents/L. This concentration of Fe(III)chelate bleaching agent is that concentration resulting after the oxidation of any developing agent in the mixture has taken place. Such oxidation results in the reduction of an equivalent of Fe(III) chelate to Fe(II)chelate for each equivalent of developing agent that is oxidized and results in a lower concentration of Fe(III)chelate bleaching agent in the mixture that is available for bleaching silver. The more preferred Fe(III)chelate bleaching agents are Fe(III) complexes of ethylenediaminetetraacetic acid, 1,3-propanediamine-N,N,N',N'-tetraacetic acid, ethylenediamine-N-(2-carboxyphenyl)-N,N',N'-triacetic acid, ethylenediaminedisuccinic acid (particularly the S,S-isomer), ethylenediaminemonosuccinic acid, N-(2-carboxyethyl)aspartic acid, and N-methyliminodiacetic acid, which may be used alone or in combination.

When processing solutions are added to the processing chamber to form a bleach-fixing solution mixture, the pH of the bleach-fixing solution mixture should be from about 4 to about 8, preferably from about 4.5 to 7, and more preferably from about 4.5 to 6.5. At pH's lower than about 4.5, bleaching occurs quite rapidly, but the formation of colorless (leuco) forms of cyan image dyes may occur which degrades image quality. At pH's higher than about 6.5, bleaching takes place more slowly. Also, the non-imagewise formation of image dye from bleach-induced dye formation (bleach stain) can occur at higher bleach-fixer pH's, causing.densities of the photographic material to be unacceptably high.

These desired concentrations of fixing agents and bleaching agents can be achieved with low applied volumes of stop, fixer, bleach, or bleach-fixer solutions added to the developer solution when the volume of applied developer solution is also kept low. This is because the volume of each solution—developer, stop, fixer, bleach, or bleach-fixer—dilutes the constituents of each solution comprising the merged mixture. In addition, the developing agent reduces some of the bleaching agent in the mixture making less available to accomplish bleaching of developed silver.

Lower volumes of solutions can be used to achieve the necessary processing concentrations if they are more concentrated in fixing and bleaching agents, but even so, there is a limit to the solubility of processing agents in aqueous solution. The pH parameters can also be easily met when the volume of applied developer solution is kept low. This is because with less applied developer solution, there is less alkalinity present that must be neutralized to stop development and to adjust the pH into the range for rapid and effective desilvering by the merged mixture. This alkalinity is neutralized by providing the stop, fixer, bleach, or bleach-fixer solutions with a suitably low pH and a quantity of one or more acid-providing buffers. Applied processing solutions are measured in terms of the volume added per unit area of material to be processed, for example, in milliliters of solution per square meter of photographic material.

For example, in the merged process method the applied volume of various processing solutions can be as shown below.

| | Applied Volume |
|---|---|
| Add developer to processing chamber and develop | 566 mL/m$^2$ |
| Add fixer solution to processing chamber to stop development | 377 mL/m$^2$ |
| Add bleach solution to processing chamber to bleach and fix the material | 377 mL/m$^2$ |

Often, however, a larger volume of developer is desirable or necessary in order to develop the material more rapidly or with improved uniformity. However, if a larger volume of developer is applied, then a larger volume of fixer (or a more concentrated fixer solution), a larger volume of bleach solution (or a more concentrated solution of bleaching agent), or a larger volume of a bleach-fixer solution (or a more concentrated bleach-fixer solution) must be applied to achieve the desired concentrations of fixing and bleaching agent in the resulting mixture in order to process sufficiently rapidly. Larger amounts of acid-providing buffers must be used to neutralize the alkalinity of the developer solution. The larger volumes of processing solution, or the use of more concentrated processing solutions, increase the cost of running the process. In particular, larger volumes of bleach or bleach-fixer solutions or more concentrated bleach or bleach-fixer solutions contribute significantly to the cost of the processing chemistry for the process.

A method of processing is needed which reduces the amount of bleaching agent, provided by a bleach solution or bleach/fix solution, which must be utilized in a merged process utilizing a single chamber processor. This is particularly needed when larger volumes of developer solution are required.

SUMMARY OF THE INVENTION

A method for processing a silver halide color photographic material comprising the steps of loading the material into a chamber adapted to hold the material therein; introducing a measured amount of a developer solution into the chamber; developing the photographic material with the developer solution; introducing into the chamber a measured amount of a processing solution which arrests development, without removing th e developer solution, to form a developer/stop solution mixture; processing the photographic material with the developer/stop solution mixture, substantially removing all of the developer/stop mixture solution from the chamber; then providing in the chamber a bleach/fixer solution mixture comprising a bleaching agent and a fixing agent; and processing the photographic material with the bleach/fixer solution mixture; wherein the color developer solution is utilized in the amount of greater than or equal to 375 ml/m$^2$ of the photographic material that is processed; and wherein the total volume of solution or solution mixture for each processing stage is spread over the whole area of the photographic material in a repetitive manner to enable uniform processing. In one embodiment the ratio of the bleaching agent equivalents utilized in the process to the volume of color developer solution utilized in the process, in liters, is less than or equal to 0.48.

This invention provides a more cost effective method for processing silver halide elements in a single chamber processor by reducing the amount of bleaching agent, provided by a bleach solution or bleach/fix solution, which must be utilized. The inventive process also uses less total processing solution volume. The advantages of the invention become greater if the applied developer volume must be increased further in order to process satisfactorily, such as with greater rapidity or uniformity.

DETAILED DESCRIPTION OF THE INVENTION

Figure 1B:
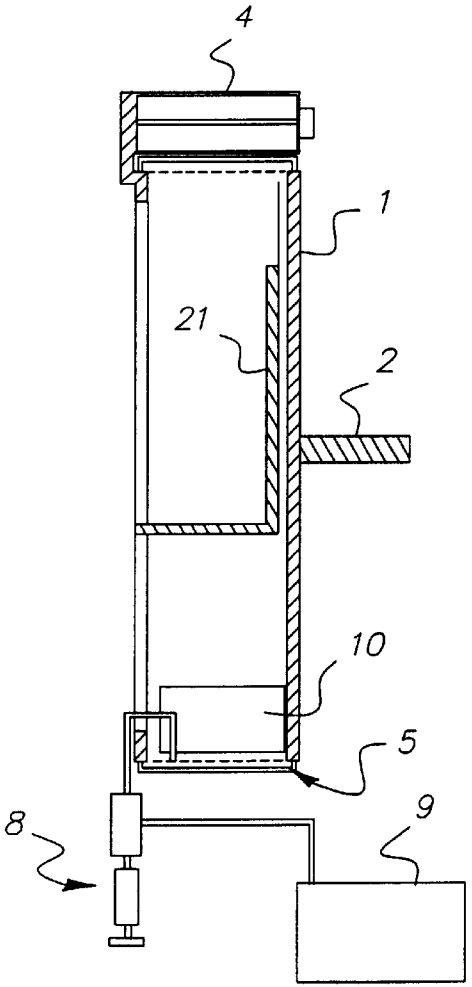
FIGS. 1A and 1B show a schematic side view and section view, respectively, of apparatus in which the method of the present invention can be performed.

In the method of the invention the silver halide color photographic material is loaded into a chamber adapted to hold the material therein; a measured amount of a developer solution is introduced into the chamber, and the photographic material is developed with the developer solution. Next a measured amount of a processing solution which arrests development is introduced into the chamber without removing the developer solution, to form a developer/stop solution mixture in the chamber. The photographic material is processed with the developer/stop solution mixture to stop development, and substantially all of the developer/stop mixture solution is removed from the chamber prior to the introduction of the next solution. In this aspect the invention differs from a preferred merged process as described above. At that point there is provided in the chamber a bleach/fixer solution mixture comprising a bleaching agent and a fixing agent, and the photographic material is processed with the bleach/fixer solution mixture. In this method the total volume of solution or solution mixture for each processing stage is spread over the whole area of the photographic material in a repetitive manner to enable uniform processing. The method of merged processing whereby a second solution is introduced into a processing chamber prior to removal of a first processing solution is described in detail in U.S. application Ser. No. 10/012,673 of Twist filed Oct. 30, 2001, the entire specification of which is incorporated herein by reference. Although this inventive process sequence requires the additional time to remove the mixture of developer and stop solution, the overall time required for the process sequence can be just as short as the time required for the developer/fixer/bleach mixture process. In addition, the total volume of processing solutions used per square meter of photographic material processed is similar to that of the more costly developer/fixer/bleach mixture process and can be significantly less. The processing steps of the inventive method of processing may be conducted independently at a temperature of 20 to 80° C., preferably from 35 to 60°

C. by independently heating and applying the solutions at prescribed temperatures.

This invention is suitable for use when the color developer solution is utilized in the amount of greater than or equal to 375 ml/m$^2$ of the photographic material that is processed. It is more suitable when the color developer solution is utilized in the amount of greater than or equal to 470 ml/m$^2$ of photographic material that is processed, even more suitable when the color developer solution is utilized in the amount of greater than or equal to 850 ml/m$^2$ of photographic material that is processed, and most suitable when the color developer solution is utilized in the amount of greater than or equal to 1200 ml/m$^2$ of photographic material that is processed. Preferably the developer is applied in the inventive process in an amount less than 2000 mL/m$^2$ of photographic material processed.

Preferably the ratio of the bleaching agent equivalents utilized in the process to the volume of color developer solution utilized in the process, in liters, is less than or equal to 0.48, preferably less than or equal to 0.4 equivalents, more preferably less than or equal to 0.33, and most preferably less than or equal to 0.25. By "bleaching agent equivalents" is meant the following. A bleaching agent is an oxidizing agent. The quantity of oxidizing agent involved in an oxidation/reduction reaction, or redox reaction, can be expressed in terms of equivalents of oxidizing agent. An equivalent of an oxidizing agent is the amount of oxidizing agent that accepts one mole of electrons from reducing agents in an oxidation/reduction chemical reaction. Similarly, an equivalent of a reducing agent gives up one mole of electrons to oxidizing agents in a redox reaction. This invention is concerned with the amount of bleaching agent used in the process, in equivalents, relative to the volume of developer solution used in the process, in liters. When this ratio is less than or equal to certain amounts and when the applied developer solution volume is above certain amounts, then the method of processing of this invention is advantageous in terms of cost and the total volume of processing solutions required for the method of processing.

The development step may be carried out for a period from 15 to 195 seconds, preferably less than 100 seconds, and most preferably from 30 to 100 seconds for rapid processing. Photographic color developing compositions used in the invention typically include one or more color developing agents and various other conventional addenda including preservatives or antioxidants (including sulfites, and hydroxylamine and its derivatives), sulfites, metal ion sequestering agents, corrosion inhibitors, and buffers. These materials can be present in conventional amounts. For example, the color developing agent is generally present in an amount of at least 0.001 mol/l (preferably at least 0.01 mol/l), and an antioxidant or preservative for the color developing agent is generally present in an amount of at least 0.0001 mol/l (preferably at least 0.001 mol/l). The pH of the composition is generally from about 9 to about 13, and preferably from about 10 to about 12.5.

Exemplary color developing compositions and components (except the sensitizing dye stain reducing agents described herein) are described, for example, in EP-A-0 530 921 (Buongiorne et al), U.S. Pat. No. 5,037,725 (Cullinan et al), U.S. Pat. No. 5,552,264 (Cullinan et al), U.S. Pat. No. 5,508,155 (Marrese et al), U.S. Pat. No. 4,892,804 (Vincent et al), U.S. Pat. No. 4,482,626 (Twist et al), U.S. Pat. No. 4,414,307 (Kapecki et al), in U.S. Pat. No. 4,876,174 (Ishikawa et al), U.S. Pat. No. 5,354,646 (Kobayashi et al) and U.S. Pat. No. 4,264,716 (Vincent et al), all incorporated herein for their teaching about color developing compositions.

Useful preservatives in the color developing compositions include sulfites (such as sodium sulfite, potassium sulfite, sodium bisulfite and potassium metabisulfite), hydroxylamine and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phospho, hydroxy, carbonamido, sulfonamido or other solubilizing groups). Mixtures of compounds from the same or different classes of antioxidants can also be used if desired.

Examples of useful antioxidants are described, for example, in U.S. Pat. No. 4,892,804 (noted above), U.S. Pat. No. 4,876,174 (noted above), U.S. Pat. No. 5,354,646 (noted above), U.S. Pat. No. 5,660,974 (Marrese et al), and U.S. Pat. No. 5,646,327 (Bums et al), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

Most preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference. Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Particularly useful color developing agents include aminophenols, p-phenylenediamines (especially N,N-dialkyl-p-phenylenediamines) and others which are well known in the art, such as EP 0 434 097 Al (published Jun. 26, 1991) and EP 0 530 921 Al (published Mar. 10, 1993). Preferred color developing agents include, but are not limited to, N,N-diethyl p-phenylenediamine sulfate (KODAK Color Developing Agent CD-2), 4-amino-3-methyl-N-(2-methane sulfonamidoethyl )aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

Development may be arrested by adding a stop solution, a fixer solution, a bleach solution, or a bleach-fixer solution to the processing chamber containing the developer solution, thoroughly mixing the solutions together to form a developer/stop solution, and bringing the mixture into contact with the photographic material. This processing step is performed for a period from 5 to 60 seconds, preferably for a period of less than 30 seconds, and most preferably for a period from 10 to 30 seconds. Preferably an acidic stop solution or a fixer solution is used. More preferably a fixer solution is used. This fixer solution can be the same composition as the one used to form the bleach-fixer mixture subsequently in the processing chamber. A stop solution stops development by rapidly lowering the pH of the mixture below that at which development occurs. A bleach solution also stops development by rapidly lowering the pH of the mixture. A fixer when added to the developer solution can stop development by fixing or dissolving some of the silver halide. A stop/fix solution is simply a low pH fix solution that stops development by lowering pH and as well as by fixing silver halide. The pH of the mixture may be lowered also by one or more acid-providing buffer compounds in the solution that arrests development. Such buffers include carboxylic acids such as acetic acid, succinic acid, maleic acid, and sulfosuccinic acid, and amine salts such as imidazolium salts. The developer/stop solution is then substantially removed from the chamber. There may be some developer/stop solution remaining in the chamber since the chamber is not normally rinsed before the next step.

The bleach/fixer solution mixture comprising a bleaching agent and a fixing agent may be provided to the chamber in many fashions, and the term "provided" may include any of the following. The bleach/fixer solution mixture may be provided by combining a measured amount of a bleach solution and a measured amount of a fixer solution prior to introducing them into the chamber, or the bleach/fixer solution mixture may be provided by introducing separately into the chamber a measured amount of a fixer solution and a measured amount of a bleach solution. The bleach solution may be introduced into the chamber before the fixer solution, the fixer solution may be introduced into the chamber before the bleach solution or the fixer solution, and the bleach solution may be introduced into the chamber simultaneously. There may also be utilized a pre-prepared bleach/fixer solution, such as KODAK EKTACOLOR RA Bleach-Fix which is marketed by Eastman Kodak Company, Rochester, New York wherein a measured amount of the pre-prepared bleach/fixer solution is introduced into the chamber. The pre-prepared bleach/fixer solution and a measured amount of a bleach solution may be introduced into the chamber, with either solution being introduced first or both solutions may be introduced into the chamber simultaneously. They may also be mixed before introduction to the chamber. The pre-prepared bleach/fixer solution may also be introduced with a measured amount of a fixer solution, again with either solution being introduced first or both solutions introduced into the chamber simultaneously. Again, the solutions may be mixed before introduction into the chamber. A preferred method of providing the bleach/fixer solution mixture within the processing chamber is to add a measured amount of a concentrated fixer solution and a measured amount of a concentrated bleach solution to the processing chamber, or to form a mixture of the fixer and bleach solutions just prior to introducing the mixture to the chamber.

The bleaching and fixing may be independently or simultaneously conducted for a period from 10 to 240 seconds, preferably less than 120 seconds, and. most preferably from 15 to 120 seconds for rapid processing. For example, the fixer solution may be introduced first into the processing chamber to fix the photographic material, and after a time a bleach or a bleach-fixer solution can be added to the chamber to bleach the material. Alternatively, a bleach solution may be introduced first into the processing chamber to begin bleaching the photographic material, and after a time a fixer or a bleach-fixer solution can be added to the chamber to fix the material.

In this inventive process, the concentration of fixing agents in the bleach-fixing mixture within the processing chamber should be at least about 0.75 mol/L, preferably at least about 1 mol/L up to about 2 mol/L. The concentration of bleaching agents in the bleach-fixing mixture within the processing chamber should be at least about 0.2 equivalents/L, preferably at least about 0.25 equivalents/L up to about 0.6 equivalents/L.

When processing solutions are added to the processing chamber to form a bleach-fixing solution mixture, the pH of the bleach-fixing solution mixture should be from about 4 to about 8, preferably from about 4.5 to 7, and more preferably from about 4.5 to 6.5. At pH's lower than about 4.5, bleaching occurs quite rapidly, but the formation of colorless (leuco) forms of cyan image dyes may occur which degrades image quality. At pH's higher than about 6.5, bleaching takes place more slowly. Also, the non-imagewise formation of image dye from bleach-induced dye formation (bleach stain) can occur at higher bleach-fixer pH's, causing densities of the photographic material to be unacceptably high.

The concentration of fixing agents in the fixer solution should be from about 1.3–5 mol/L, preferably from about 2–5 mol/L, and more preferably from about 2–4 mol/L. The pH of the fixer solution should be from about 4.5–8, preferably from about 5 to 7.5, and more preferably from about 5.25 to 7 for the best overall chemical stability. The concentration of bleaching agents in the bleach solution should be at least about 0.25 equivalents/L, preferably at least 0.3 equivalents/L, and more preferably at least 0.375 equivalents/L. The concentration of bleaching agents in the bleach solution can be as high as 1.7 equivalents/L. More concentrated fixer solutions allow the process to be run more economically with lower volumes of fixer solution having to be applied and with lower amounts of bleaching agents in the bleaching or bleach-fixing solutions having to be applied. Likewise, more concentrated bleach or bleach-fixing solutions allow the process to be run more economically with lower volumes of bleach or bleach-fixing solutions having to be applied and with lower amounts of fixing agents in the fixer solution having to be applied.

Photographic bleaching compositions which may be used in this invention generally include one or more high metal valent ion bleaching agents, such as iron(III) complexes with simple anions (such as nitrate, sulfate, and acetate), or with carboxylic acid or phosphonic acid ligands. Particularly useful bleaching agents include iron complexes of one or more aminocarboxylic acids, aminopolycarboxylic acids, polyaminocarboxylic acids or polyaminopolycarboxylic acids, or salts thereof. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar com*pounds as described in EP-A*-0 532,003, and ethylenediamine monosuccinic acid and similar compounds as described in U.S. Pat. No. 5,691,120 (Wilson et al), all of which are incorporated herein by reference in relation to their description of bleaching agents.

These and many other such complexing ligands known in the art including those described in U.S. Pat. No. 4,839,262 (Schwartz), U.S. Pat. No. 4,921,779 (Cullinan et al), U.S. Pat. No. 5,037,725 (noted above), U.S. Pat. No. 5,061,608 (Foster et al), U.S. Pat. No. 5,334,491 (Foster et al), U.S. Pat. No. 5,523,195 (Darnon et al), U.S. Pat. No. 5,582,958

(Buchanan et al), U.S. Pat. No. 5,552,264 (noted above), U.S. Pat. No. 5,652,087 (Craver et al), U.S. Pat. No. 5,928,844 (Feeney et al) U.S. Pat. No. 5,652,085 (Wilson et al), U.S. Pat. No. 5,693,456 (Foster et al), U.S. Pat. No. 5,834,170 (Craver et al), and U.S. Pat. No. 5,585,226 (Strickland et al), all incorporated herein by reference for their teaching of bleaching compositions.

Other components of the bleaching solution include buffers, halides, corrosion inhibiting agents, and metal ion sequestering agents. These and other components and conventional amounts are described in the references in the preceding paragraph. The pH of the bleaching composition is generally from about 3.5 to about 6.5.

The more preferred Fe(III)chelate bleaching agents are Fe(III) complexes of ethylenediaminetetraacetic acid (EDTA), 1 ,3-propanediamine-N,N,N',N'-tetraacetic acid (PDTA), ethylenediamine-N-(2-carboxyphenyl)-N,N',N'-triacetic acid, ethylenediaminedisuccinic acid (particularly the S,S-isomer), ethylenediaminemonosuccinic acid, N-(2-carboxyethyl) aspartic acid, and N-methyliminodiacetic acid, which may be used alone or in combination. The most preferred bleaching agent is a ferric ion complex of PDTA for processing color reversal and color negative materials rapidly. For processing color paper materials a ferric complex of EDTA is preferred. Multiple bleaching agents can be present if desired.

Fixing solutions which may be used in the invention contain a photographic fixing agent. Examples of photographic fixing agents include, but are not limited to, thiosulfates (for example, sodium thiosulfate, potassium thiosulfate, and ammonium thiosulfate), thiocyanates (for example, sodium thiocyanate, potassium thiocyanate, and ammonium thiocyanate), thioethers (such as ethylenebisthioglycolic acid and 3,6-dithia-1,8-octanediol), imides, and thiourea. Thiosulfates and thiocyanates are preferred, and thiosulfates are more preferred. Ammonium thiosulfate is most preferred.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing.accelerators are described in U.S. Pat. No. 5,633,124 (Schmittou et al), incorporated herein for the teaching of fixing compositions.

Fixing compositions generally contain one or more monovalent or divalent cations supplied by various salts used for various purposes (for example, salts of fixing agents). It is preferred that the cations be predominantly ammonium cations, that is at least 50 % of the total cations are ammonium ions. Such fixing compositions are generally known as "high ammonium" fixing compositions.

Fixing compositions can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

Other details of fixing compositions not explicitly described herein are considered well known in the art and are described, for example, in *Research Disclosure* publication 38957 (noted below), and publications noted therein in paragraph XX(B), U.S. Pat. No. 5,424,176 (Schmittou et al), U.S. Pat. No. 4,839,262 (noted above), U.S. Pat. No. 4,921,779 (noted above), U.S. Pat. No. 5,037,725 (noted above), U.S. Pat. No. 5,523,195 (noted above), U.S. Pat. No. 5,552,264 (noted above), all incorporated herein by reference for their teaching of fixing compositions.

Following bleaching and fixing one or more washing or rinsing steps may be carried out either within or externally to the processing chamber. These steps may be performed for a period of 5 to 120 seconds, preferably from 10 to 30 seconds if within the processing chamber. Each washing or rinsing solution within the processing chamber is substantially removed from the chamber before any subsequent washing or rinsing solution is added to the chamber. The washed or rinsed photographic material may then be dried within or externally to the processing chamber.

The used processing solutions from the inventive process can be delivered to one or more waste containers for silver recovery, developer oxidation, and control of corrosivity as described in U.S. application Ser. No. 10/021,703 of Schmittou filed Oct. 30, 2001. For example, silver-bearing fixer-containing or bleach-fixer-containing wastes and subsequent wash or rinse solutions can be added to a container containing a silver precipitating agent such as trisodium trimercapto-s-triazine (TMT). This lowers the soluble silver concentration so that the waste may be safely transported, and the precipitated silver can be easily recovered. The waste bleaching or bleach-fixing solution can be added to a container containing waste developer so that the developer may be oxidized by the bleaching agent. A single waste container may contain all of the processing solution waste liquid from the process. The pH and buffer content of the processing solutions and the alkaline nature of the TMT silver precipitating agent can be selected so that the waste mixture or mixtures have a pH greater than or equal to about 7.0, rendering the waste non-corrosive to low-carbon steel.

The inventive process can be very effectively applied to the system and method of processing photographic film images that is described in U.S. application Ser. No. 10/051,074 of Hall et al filed Jan. 18, 2002. The individual steps of development, stoppage of development, and bleach-fixing can be individually adjusted and programmed for processing time, processing solution temperature, and processing solution composition based on the type of photographic material being processed. If a separate fixer or separate bleach solution is used in the formation of the bleach-fixer mixture within the processing chamber, then these solutions can be individually measured and delivered to the chamber to control the amounts of fixing agents and bleaching agents in the mixture for each photographic material. Such control of processing conditions can help optimize a process for processing speed, processing ecology, or processing economy, or energy usage.

Figure 1A:
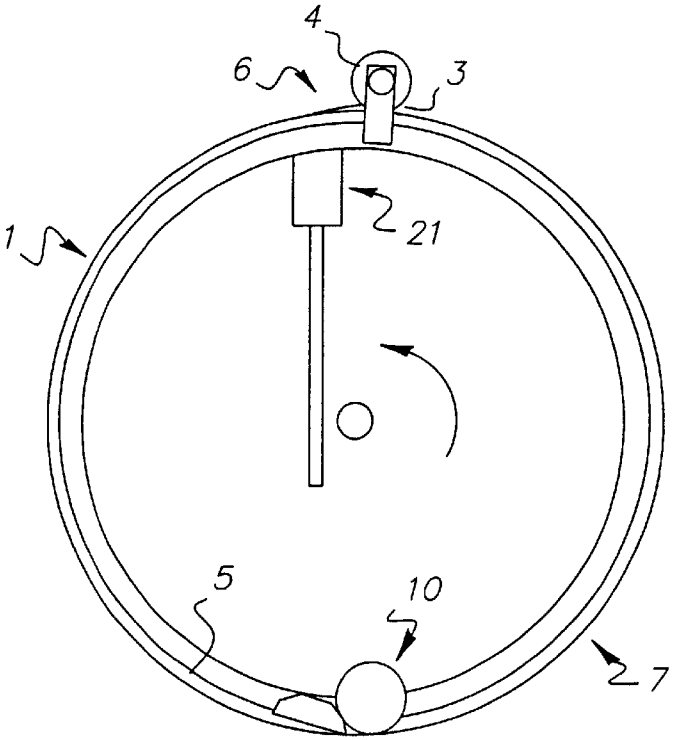

The method of the invention may be performed in a single use wave processor of the type disclosed in co-pending application no GB 0023091.2, filed on Sep. 20 2000, also incorporated herein by reference. The processor comprises an apparatus for processing a photographic material, comprising a chamber adapted to hold the material therein, means. for introducing a measured amount of solution into the chamber, means for removing the solution from the chamber, means for rotating the chamber and means for sweeping the surface of the material at each rotation of the chamber, thereby to form a wave in the solution through which the material may pass. FIGS. 1A and 1B show a single use wave processor.

The wave processor comprises a cylinder 1 having at least one open end. The cylinder may be made of stainless steel, plastics, or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber. A close fitting cover (not shown) may be provided around the inner circumference of the chamber which sits above the film surface by at least 0.5 mm. This cover provides at least three functions to improve the performance of the apparatus. Firstly, it lowers water evaporation which can cause a temperature drop and can concentrate the processing solution as processing is occurring. Secondly, it can itself provide agitation by maintaining a puddle of solution in the gap between the cover and the film surface at the lowest point of the chamber. Thirdly, it provides a film retaining means making edge guides unnecessary, although edge guides can be also be provided to prevent the film sticking to the cover. It allows both 35 mm film and APS film (24 mm) to be loaded in the same apparatus, and it also allows any length of film to be loaded. The material of the cover can be impervious to processing solution and as such is provided with a break or gap in its circumference so that the two extreme ends of the cover do not meet and through which processing solution is added to the film surface. In this embodiment the cover is fixed and rotates with the chamber as the chamber rotates. In another embodiment the cover is not fixed and rests on rails on each side which allow the cover to slide and remain stationary as the chamber rotates. In this embodiment the cover is again provided with a break or gap in its circumference so that processing solutions can be added to the film surface. In this embodiment a roller can also be provided which sits in the gap in the circumference of the cover and which remains essentially at the lowest point of the chamber. The roller provides additional agitation. In another embodiment the cover can be made of a material which is porous to processing solution such as a mesh material or a material punctured with holes. The cover can be made of plastic, metal, or any suitable material. However, the cover is not an essential feature of the invention.

A drive shaft 2 is provided at the closed end of the cylinder for rotation thereof. The open end of the cylinder 1 is provided with a flange 7. The flange retains solution within the chamber. In the embodiment shown in FIG. 1B the processing solutions are introduced into and removed from the chamber by means of syringes 8. However any suitable means may be used, for example, metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. When required, merged solutions may be removed by suction or any other means. Residue of solutions therefore do not build up within the processing chamber. This results in the processing chamber being essentially self cleaning. The crossover times from one solution to another are very short. It is possible to mount an infrared sensor outside of the chamber. The sensor monitors the silver density of the material during development thereof.

A wave forming mechanism is provided within the processing chamber. This wave forming mechanism sweeps the film surface and forms a wave of solution, primarily at the lowest point in the chamber. In the embodiment shown in FIG. 1 the mechanism is a freestanding roller 10. It is possible that this roller may be held on a loose spindle (not shown) which would allow the roller to be steered and also to be raised and lowered into position. The position of the roller can be changed with this mechanism so that it is to the left or right of bottom dead center which can be advantageous for the smooth running of the roller. It is also desirable to raise or lower the roller which might facilitate film loading.

In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached, a given volume of a first processing solution is introduced into the chamber. The processing solution may be heated prior to being introduced into the chamber. Alternatively the solution may be unheated or cooled. As the chamber rotates, the film is continuously re-wetted with the given volume of solution.

Processing solution is added onto the roller 10 which is contacted across the whole width thereof by a spreader 52. This can be seen in more detail in FIG. 2. The spreader may be made of flexible soft plastic, rigid plastic, or any other suitable material. The roller 10 rotates in contact with the spreader 52. Processing solution is delivered, via a supply pipe, down the spreader to the region of contact between the roller and the spreader. This method forms a uniform bead of solution over the region of contact between the roller and the spreader that extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation which gives uniform processing even with very active processing solutions. High agitation and mixing are required when only small volumes of solution are being used. If a large volume of solution is added to the chamber in the absence of a wave forming mechanism, a "puddle" of solution is formed, and spreading and agitation is achieved. However if a small volume of solution is added to the chamber in the absence of a wave forming mechanism, then solution adheres to the film as the chamber rotates. There is no "puddle" formed, and there is consequently no agitation or mixing and processing is slow and non-uniform. The agitation and mixing mechanism of the present invention, i.e., the wave forming mechanism, is sufficient to minimize density differences from the front to the back of the film.

Once the first stage of the processing is completed, a given volume of the next processing solution or solid is then introduced into the chamber after the desired time and so on. When merged solution processing is complete, the merged solutions are removed. Finally, the wash solutions are added and removed. The normal mode of operation of the method of the invention is to perform the complete process cycle within the single processing space of the rotating chamber. The process cycle may be develop, stop, bleach, fix, and wash. The processing solution for each stage is added to the chamber and left for the required time. The film 5 may be dried in-situ with hot air. The whole process cycle may thus be carried out within a single processing space Representative sequences for processing various color photographic materials are described, for example, in *Research Disclosure* publication 308119, December 1989; publication 17643, December 1978; and publication 38957, September 1996.

Silver halide photographic elements which are processed include color negative photographic films, color reversal photographic films, and color photographic papers. Color negative element and particularly color negative films are most preferred. The general sequence of steps and conditions (times and temperatures) for processing are well known as Process C-41 and Process ECN-2 for color negative films, Process E-6 and Process K-14 for color reversal films, Process ECP for color prints, and Process RA-4 for color papers.

For example, color negative films that can be processed using the compositions described herein include, but are not limited to, KODAK MAX™πfilms, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTIX™ films, FERRANIA SOLARIS films, FUJI SUPER G Plus films, FUJI SMARTFILM™ products, FUJICOLOR NEXIA™ films, FUJICOLOR SUPERIA™ films, FUJICOLOR REALA™ films, KONICA DX films, KONICA VX films, KONICA CENTURIA™ films, KONICA SR-G films, KONICA SUPER XG films, KONICA SUPER SR films, KONICA SUPER DD films, 3M SCOTCH™ ATG films, SCOTCHCOLOR™ films, AGFA VISTA films, AGFA FUTURA films, AGFA ULTRA films, and AGFA HDC and XRS films. Films processed can also be those incorporated into what are known as "single-use cameras".

In addition, color papers that can be processed include, but are not limited, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7, and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art. KODAK DURATRANS, KODAK DURACLEAR, KODAK EKTAMAX RAL and KODAK DURAFLEX photographic materials, and KODAK Digital Paper Type 2976 are also typically processed as described above.

As noted the method of the invention is preferably used to provide a color image in an exposed color negative silver bromoiodide film element. The color negative film element may comprise a support and one or more silver halide emulsion layers (or color records) containing an imagewise distribution of developable silver halide emulsion grains, and has one or more color forming couplers associated therewith.

Generally, the iodide content of such silver bromoiodide emulsions is less than about 40 mol % (based on total silver), preferably from about 0.05 to about 10 mol %, and more preferably from about 0.5 to about 6 mol %. The emulsions can be of any crystal morphology (such as cubic, octahedral, cubooctahedral, or tabular as are known in the art), or irregular morphology (such as multiple twinning or rounded). Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; and 4,173,320; Daubendiek et al U.S. Pat. Nos. 4,414,310 and 4,914,0.14; Sowinski et al U.S. Pat. No. 4,656,122; Piggin et al U.S. Pat. Nos. 5,061,616 and 5,061,609; Tsaur et al U.S. Pat. Nos. 5,147,771; '772; '773; 5,171,659; and 5,252,453; Black et al U.S. Pat. Nos. 5,219,720 and 5,334,495; Delton U.S. Pat. Nos. 5,310,644; 5,372,927 and 5,460,934, Wen U.S. Pat. NO. 5,470,698; Fenton et al U.S. Pat. No. 5,476,760; Eshelman et al U.S. Pat. Nos. 5,612,175 and 5,614,359; and Irving et al U.S. Pat. No. 5,667,954.

Ultrathin high bromide { 111 } tabular grain emulsions are illustrated by Daubendiek et al U.S. Pat. Nos. 4,672,027; 4,693,964; 5,494,789; 5,503,971 and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

Such color silver bromoiodide elements generally have a camera speed defined as an ISO speed of at least 25, preferably an ISO speed of at least 50, and more preferably an ISO speed of at least 100. The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27–1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The photographic elements processed in the practice of this invention can be single or multilayer color elements. Preferably, the elements have at least two separate light sensitive emulsion layers, and each layer contains a silver bromoiodide emulsion as defined above. Preferably the elements are multilayer color elements typically containing dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats, and other layers readily apparent to one skilled in the art. A magnetic backing can be used as well as conventional supports.

The photographic element may also comprise a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94–6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, and *Research Disclosure*, September 1997, Item 40145, both published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 & 4 | I, II, III, IX A & B | aids, addenda, etc. |
| 1 | III, IV | Chemical sensitization and |
| 2 | III, IV | spectral sensitization/ |
| 3 & 4 | IV, V | Desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; U.S. Pat. Nos. 4,865,956; and U.S. Pat. Nos. 4,923,784 may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; U.S. Pat. Nos. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The photographic elements may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. Nos. 4,420,556; and U.S. Pat. Nos. 4,543, 323.) Also, the compositions may be blocked or coated in protected form as described, for example, in Japanese application 61/258,249 or U.S. Pat. No. 5,019,492.

The photographic elements may further be used in combination with image-modifying compounds such as "Developer Inhibitor-Releasing" compounds (DIR's). DIR's useful in conjunction with the compositions of the invention are known in the art and examples are described in U.S. Pat. No. Nos. 3,137,578; 3,148,022; 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; and 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

The following examples illustrate the practice of this invention. They are not intended to be exhaustive of all possible variations of the invention. Parts and percentages are by weight unless otherwise indicated.

EXAMPLES

Example 1

To demonstrate the cost advantages of the inventive process, first consider comparative Processes A, conducted as described in Example 2 Merged Process Cycle(A) of U.S. application Ser. No. 10/012,673 of Twist filed Oct. 30, 2001. The volume requirements to conduct this process are shown in Table I, for various applied volumes of Developer A solution. These amounts are the minimum desired to achieve satisfactory rapid fixing and bleaching of a color negative film - about 0.75 mol/L of thiosulfate for fixing, and about 0.12 equivalents/L of Fe(III)PDTA for bleaching by the mixture.

Next, consider the inventive Process B. The volume requirements to conduct this process are shown in Table II, for various applied volumes of Developer A solution, the same volumes used to illustrate Processes A. The concentrations of fixing agents and bleaching agents in the fixer and bleach solutions are the same as for Process A, in order to compare the two processes fairly. However, the applied volumes of fixer and bleach are significantly different.

For Process A, the combined volumes of Developer A, Fixer A, and Bleach A result in a thiosulfate concentration of 0.75 mol/L and a Fe(III)PDTA concentration of 0.12 equivalents/L after developer oxidation for equally rapid processing for each process. If a higher volume of developer is used in Process A, a proportionately higher volume of bleach (and fixer) is required, with a proportional increase in relative cost. The ratio of applied bleaching agent equivalents to the developer volume in liters is constant, reflecting the constant proportion of bleach solution to developer solution. Higher volumes of fixer and bleach may be used for even more rapid bleaching and fixing with a constant amount of developer, but at a higher relative solution cost. Relative costs per unit volume of Developer A, Fixer A, and Bleach A are 1.69, 1.0, and 8.17, respectively. Therefore, the amount of bleach used in the process greatly controls the overall chemical cost for the process. In particular, there is concern with the amount of bleaching agent relative to the amount of developer solution used in the process when we compare processes.

The inventive Process B adds a first volume of fixer to the developer to stop development, after which the combined developer/fixer solution is removed from the processing chamber. A residual solution volume of at least about 94 $mL/m^2$ of processed material will be retained in the chamber after solution removal. Next are added to the processing chamber a second volume of fixer and a volume of bleach to complete bleach-fixing of the material. The retained volume of the developer/fixer mixture will mix with the new bleach-fix mixture. Alternatively, the bleach-fix mixture could be formed by introducing a single bleach-fixer solution into the processing chamber with or without a separate second solution such as a fixer solution, a bleach solution, or an accelerator solution. In general, the combined volumes of the fixer solution (second amount added) and the bleach solution, or the volume of the bleach-fixer solution and any second solution if used should constitute no more than 95% of the total volume of the resulting bleach-fixer mixture in the chamber, including the volume of any residual developer/fixer mixture that was not previously able to be removed from the chamber. Preferably, the combined volumes should constitute no more than 93.3% of the total volume, and more preferably no more than 91.7% of the total volume.

In Table II the combined volumes of Fixer A ($2^{nd}$ volume) and Bleach B result in a thiosulfate concentration of 0.75 mol/L and a Fe(III)PDTA concentration of 0.2 equivalents/L for bleach-fix processing. The concentration of bleaching agents in the bleach-fixer mixture in the chamber may be as low as 0.2 equivalents/L. Note that this is a higher concentration of bleaching agent (and a more rapidly bleaching bleach-fixer mixture) than can be cost-effectively achieved in the comparative Process A. The concentration of fixing agents in the bleach-fixer mixture in the chamber may be as low as 0.75 mol/L. Relative costs per unit volume of Developer A, Fixer A, and Bleach B are 1.69, 1.0, and 7.47, respectively. Note that the relative cost of Bleach B is less than that of Bleach A. The inventive Process B does not require as much acid-providing buffer to form the bleach-fixer mixture, because the developer has been substantially removed from the chamber before the bleach-fixer mixture is provided to the chamber. As with Process A, the amount of bleaching agent used greatly determines the chemical cost of the process.

When the ratio of the number of bleaching agent equivalents used in the inventive Process B to the volume of developer solution (in liters) is approximately equal to or less than the corresponding ratio for Process A, the inventive Process B is less costly than the comparative Process A that uses the same applied developer volume (compare Process A8 with Process B8, A14 with B14, etc.). At even higher applied developer volumes, the inventive process also uses less total processing solution volume than the comparison process (compare Process A6 with Process B6, etc), an additional advantage. The advantage of Process B becomes even greater as the applied developer volume is increased further.

The ratio of the number of bleaching agent equivalents used in the inventive process to the volume of developer solution (in liters) should be less than or equal to about 0.48 equivalents of bleaching agent per liter of applied developer solution, preferably less than or equal to 0.4 equivalents of bleaching agent per liter of applied developer solution, more preferably less than or equal to 0.33 equivalents of bleaching agent per liter of applied developer solution, most preferably less than or equal to 0.25 equivalents of bleaching agent per liter of applied developer solution.

As shown in the subsequent Examples, the preferred 0.4 ratio is suitable when moderately concentrated fixer (from 2–3 mol/L fixing agent) and bleach (up to about 0.4 mol/L bleaching agent) solutions are used. The more preferred 0.33 ratio is suitable under the foregoing conditions and, in addition, when a moderately concentrated fixer (from 2–3 mol/L fixing agent) and a more concentrated bleach (from 0.4–0.5 mol/L bleaching agent) are used. The most preferred 0.25 ratio is suitable under the foregoing conditions and, in addition, when a highly concentrated fixer (more than 3 mol/L fixing agent) or a very concentrated bleach (more than 0.5 mol/L bleaching agent) are used.

The developer is applied in the inventive process in an amount greater than 375 mL/$^2$, preferably in an amount greater than 470 mL/$^2$, more preferably in an amount greater than 850 mL/m$^2$, most preferably in an amount greater than 1200 mL/m$^2$ of photographic material processed. The developer is applied in the inventive process in an amount less than 2000 mL/m$^2$ of photographic material processed.

As shown in the subsequent Examples, the preferred amount of 470 mL/m$^2$ is suitable when a moderately concentrated fixer (from about 2–3 mol/L fixing agent) and a moderately concentrated bleach is used (up to about 0.4 mol/L bleaching agent). Also, this amount is suitable when a highly concentrated fixer (greater than about 3 mol/L fixing agent) or a very concentrated bleach is used (greater than about 0.5 mol/L bleaching agent). The more preferred amount of 850 mL/$^2$ is suitable under the foregoing conditions and, in addition, when a moderately concentrated fixer (fixing agent concentration of about 2–3 mol/L) and more concentrated bleach solutions are used (bleaching agent concentration greater than 0.4 mol/L.

The cost of Bleach B used in Processes B is about 8% cheaper than the cost of Bleach A used in Processes A, and this contributes to a small extent to some of the cost advantage of Processes B. However, the major cost advantage for Processes B can be seen to be the significantly lower volume of Bleach B that is used compared to the volume of Bleach A required for Processes A (at the same applied developer volume).

TABLE I

Example 1

| Comparative Processes A | Developer A Volume, mL/m$^2$ | Fixer A Volume, mL/m$^2$ | Bleach A Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| A1 | 187 | 179 | 271 | 637 | 2710 | 0.454 | |
| A2 | 281 | 268 | 406 | 956 | 4064 | 0.454 | |
| A3 | 375 | 357 | 542 | 1274 | 5419 | 0.454 | |
| A4 | 469 | 447 | 677 | 1593 | 6774 | 0.454 | comparison |
| A5 | 562 | 536 | 813 | 1911 | 8129 | 0.454 | comparison |
| A6 | 656 | 625 | 948 | 2230 | 9484 | 0.454 | comparison |
| A7 | 750 | 715 | 1084 | 2548 | 10839 | 0.454 | comparison |
| A8 | 843 | 804 | 1219 | 2867 | 12193 | 0.454 | comparison |
| A9 | 937 | 893 | 1355 | 3185 | 13548 | 0.454 | comparison |
| A10 | 1031 | 983 | 1490 | 3504 | 14903 | 0.454 | comparison |
| A11 | 1125 | 1072 | 1625 | 3822 | 16258 | 0.454 | comparison |
| A12 | 1218 | 1162 | 1761 | 4141 | 17613 | 0.454 | comparison |
| A13 | 1312 | 1251 | 1896 | 4459 | 18968 | 0.454 | comparison |
| A14 | 1406 | 1340 | 2032 | 4778 | 20322 | 0.454 | comparison |

Relative Cost per Volume: Developer A:Fixer A:Bleach A is 1.69:1.0:8.17

[a]Total Relative Solution Cost = (Developer Volume * Relative Developer Cost) + (Fixer Volume * Relative Fixer Cost) + (Bleach Volume * Relative Bleach Cost).

TABLE II

Example 1

| Processes B | Developer A Volume, mL/m$^2$ | Fixer A 1$^{st}$ Volume, mL/m$^2$ | Fixer A 2$^{nd}$ Volume, mL/m$^2$ | Bleach B Volume, mL/m$^2$ | Total Volume, mL/m$^2$ | Total Relative Solution Cost[a] | Bleach Equivalents/ Developer Volume (L) | Comments |
|---|---|---|---|---|---|---|---|---|
| B1 | 187 | 83 | 315 | 716 | 1302 | 6065 | 1.200 | |
| B2 | 281 | 125 | 315 | 716 | 1438 | 6265 | 0.800 | |
| B3 | 375 | 167 | 315 | 716 | 1573 | 6465 | 0.600 | |
| B4 | 469 | 208 | 315 | 716 | 1708 | 6665 | 0.480 | invention |
| B5 | 562 | 250 | 315 | 716 | 1844 | 6866 | 0.400 | invention |
| B6 | 656 | 292 | 315 | 716 | 1979 | 7066 | 0.343 | invention |
| B7 | 750 | 333 | 315 | 716 | 2114 | 7266 | 0.300 | invention |
| B8 | 843 | 375 | 315 | 716 | 2250 | 7466 | 0.267 | invention |
| B9 | 937 | 417 | 315 | 716 | 2385 | 7666 | 0.240 | invention |
| B10 | 1031 | 458 | 315 | 716 | 2521 | 7866 | 0.218 | invention |
| B11 | 1125 | 500 | 315 | 716 | 2656 | 8066 | 0.200 | invention |
| B12 | 1218 | 541 | 315 | 716 | 2791 | 8266 | 0.185 | invention |
| B13 | 1312 | 583 | 315 | 716 | 2927 | 8466 | 0.171 | invention |
| B14 | 1406 | 625 | 315 | 716 | 3062 | 8666 | 0.160 | invention |

Relative Cost per Volume: Developer A:Fixer A:Bleach B is 1.69:1.0:7.47

[a]Total Relative Solution Cost = (Developer Volume * Relative Developer Cost) + (Fixer Volume * Relative Fixer Cost) + (Bleach Volume * Relative Bleach Cost).

Example 2

A more preferred concentration of fixing agents in the bleach-fixing mixture of the inventive process is greater than or equal to about 1 mol/L for more rapid bleach-fixing. A more preferred concentration of bleaching agents in the bleach-fixing mixture of the inventive process is greater than or equal to about 0.25 mol/L for more rapid bleach-fixing. Illustrative inventive processes under these more preferred conditions are Processes D in Table IV. To achieve these concentrations, it is convenient to use a more concentrated bleaching agent solution (Bleach D, 0.465 mol/L bleaching agent) than used for inventive Processes B (0.314 mol/L bleaching agent). A corresponding more concentrated bleaching solution for use in a comparative set of merged Processes C, as described in U.S. application Ser. No. 10/012,673 of Twist filed Oct. 30, 2001, is Bleach C. These comparative processes are described in Table III.

As with Processes A, the combined volumes of developer A, fixer A, and bleach C result in a fixing agent (thiosulfate) concentration of 0.75 mol/L and a bleaching agent (Fe(III) PDTA) concentration of 0.12 equivalents/L after developer oxidation for equally rapid processing for each Process C. Higher volumes of fixer and bleach may be used for even more rapid bleaching and fixing with a constant amount of developer, but at a higher relative solution cost. Relative costs per unit volume of developer A, fixer A, and bleach C are 1.69, 1.0 and 11.68, respectively, for Processes C. Relative costs per unit volume of developer A, fixer A and bleach D are 1.69, 1.0 and 10.98, respectively, for Processes D.

The cost of Bleach D used in Processes D is about 6% cheaper than the cost of Bleach C used in Processes C, and this contributes to a small extent to some of the cost advantage of Processes D. This is because Processes D do not require Bleach D to contain an acid-providing buffer in order to control the bleach-fixer solution pH. However, the major cost advantage for Processes D can be seen to be the significantly lower volume of Bleach D that is used compared to the volume of Bleach C required for Processes C (at the same applied developer volume).

When the ratio of the number of bleaching agent equivalents used in the inventive Process D to the volume of developer solution (in liters) is approximately equal to or less than the corresponding ratio for comparative Process C, the inventive Process D is less costly than the comparative Process C that uses the same applied developer volume (compare Process C4 with Process D4, C6 with D6, etc). Under these more preferred process conditions, this occurs when the ratio of the number of bleaching agent equivalents used in the inventive Process D to the volume of developer solution (in liters) is less than or equal to about 0.33 equivalents of bleaching agent per liter of applied developer solution. At even higher applied developer volumes, the inventive process also uses less total processing solution volume than the comparison process (compare Process C7 with Process D7, etc.) an additional advantage. The advantage of Process D becomes even greater as the applied developer volume is increased further.

TABLE III

Example 2

| Comparative Processes C | Developer A Volume, mL/m$^2$ | Fixer A Volume, mL/m$^2$ | Bleach C Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| C1 | 562 | 375 | 401 | 1338 | 6010 | 0.332 | |
| C2 | 656 | 438 | 468 | 1561 | 7009 | 0.332 | |

TABLE III-continued

Example 2

| Comparative Processes C | Developer A Volume, mL/m$^2$ | Fixer A Volume, mL/m$^2$ | Bleach C Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| C3 | 750 | 500 | 535 | 1784 | 8017 | 0.332 | |
| C4 | 843 | 562 | 602 | 2007 | 9016 | 0.332 | comparison |
| C5 | 937 | 625 | 668 | 2231 | 10014 | 0.332 | comparison |
| C6 | 1031 | 687 | 736 | 2454 | 11022 | 0.332 | comparison |
| C7 | 1125 | 750 | 802 | 2677 | 12021 | 0.332 | comparison |
| C8 | 1218 | 813 | 869 | 2900 | 13019 | 0.332 | comparison |
| C9 | 1312 | 874 | 936 | 3123 | 14027 | 0.332 | comparison |
| C10 | 1406 | 937 | 1003 | 3346 | 15026 | 0.332 | comparison |

Relative Cost per Volume: Developer A:Fixer A:Bleach C is 1.69:1.0:11.68

[a]Total Relative Solution Cost = (Developer Volume * Relative Developer Cost) + (Fixer Volume * Relative Fixer Cost) + (Bleach Volume * Relative Bleach Cost).

TABLE IV

Example 2

| Processes D | Developer A Volume, mL/m$^2$ | Fixer A 1$^{st}$ Volume, mL/m$^2$ | Fixer A 2$^{nd}$ Volume, mL/m$^2$ | Bleach D Volume, mL/m$^2$ | Total Volume, mL/m$^2$ | Total Relative Solution Cost[a] | Bleach Equivalents/ Developer Volume (L) | Comments |
|---|---|---|---|---|---|---|---|---|
| D1 | 562 | 250 | 420 | 605 | 1837 | 8260 | 0.500 | |
| D2 | 656 | 292 | 420 | 605 | 1973 | 8460 | 0.429 | |
| D3 | 750 | 333 | 420 | 605 | 2108 | 8660 | 0.375 | |
| D4 | 843 | 375 | 420 | 605 | 2243 | 8860 | 0.333 | invention |
| D5 | 937 | 417 | 420 | 605 | 2379 | 9060 | 0.300 | invention |
| D6 | 1031 | 458 | 420 | 605 | 2514 | 9260 | 0.273 | invention |
| D7 | 1125 | 500 | 420 | 605 | 2649 | 9460 | 0.250 | invention |
| D8 | 1218 | 541 | 420 | 605 | 2785 | 9660 | 0.231 | invention |
| D9 | 1312 | 583 | 420 | 605 | 2920 | 9860 | 0.214 | invention |
| D10 | 1406 | 625 | 420 | 605 | 3056 | 10060 | 0.200 | invention |

Relative Cost per Volume: Developer A:Fixer A:Bleach D is 1.69:1.0:10.98

[a]Total Relative Solution Cost = (Developer Volume * Relative Developer Cost) + (Fixer Volume * Relative Fixer Cost) + (Bleach Volume * Relative Bleach Cost).

Processing solutions can be used in even smaller volumes if they are more concentrated. For example, a more concentrated fixer solution, Fixer B, can be used in the inventive process, as can a more concentrated bleach solution, Bleach F.

Example 3

Using Fixer B (3.565 mol/L fixing agent) and Bleach C, the solution requirements for a series of comparative Processes E are shown in Table V. These are merged processes, conducted as described in U.S. application Ser. No. 10/012,673 of Twist filed Oct. 30, 2001. Relative costs per unit volume of developer A, fixer B, and bleach C are 1.69, 1.41, and 11.68, respectively, for Processes E. The combined volumes of developer A, fixer B,. and bleach C result in a fixing agent (thiosulfate) concentration of 0.75 mol/L and a bleaching agent (Fe(III)PDTA) concentration of 0.12 equivalents/L after developer oxidation for equally rapid processing for each Process E compared to previously described Processes A and C.

Using Fixer B and Bleach D, the solution requirements for a series of inventive Processes F are shown in Table VI. Relative costs per unit volume of developer A, fixer B, and bleach D are 1.69, 1.41, and 10.98, respectively, for Processes F. The combined volumes of fixer B and bleach D result in a preferred fixing agent (thiosulfate) concentration of at least 1.0 mol/L and a preferred bleaching agent (Fe(III)PDTA) concentration of at least 0.25 equivalents/L after mixing with about 94 mL/m$^2$ of residual developer/fixer mixture retained in the chamber after solution removal.

When the ratio of the number of bleaching agent equivalents used in the inventive Process F to the volume of developer solution (in liters) is approximately equal to or less than the corresponding ratio for comparative Process E, the inventive Process F is less costly than the comparative Process E that uses the same applied developer volume (compare Process E4 with Process F4, E6 with F6, etc.). Under these more preferred process conditions, this occurs when the ratio of the number of bleaching agent equivalents used in the inventive Process F to the volume of developer solution (in liters) is less than or equal to about 0.25 equivalents of bleaching agent per liter of applied developer solution. The inventive process also uses less total processing solution volume than the comparison process (compare Process E7 with Process F7, etc.), an additional advantage. The advantage of Process F becomes even greater as the applied developer volume is increased further.

TABLE V

Example 3

| Comparative Processes E | Developer A Volume, mL/m$^2$ | Fixer B Volume, mL/m$^2$ | Bleach C Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| E1 | 187 | 82 | 119 | 388 | 1818 | 0.294 | |
| E2 | 281 | 122 | 178 | 582 | 2728 | 0.294 | |
| E3 | 375 | 163 | 237 | 776 | 3637 | 0.294 | |
| E4 | 469 | 204 | 297 | 969 | 4546 | 0.294 | comparison |
| E5 | 562 | 245 | 356 | 1163 | 5455 | 0.294 | comparison |
| E6 | 656 | 286 | 415 | 1357 | 6364 | 0.294 | comparison |
| E7 | 750 | 326 | 475 | 1551 | 7274 | 0.294 | comparison |
| E8 | 843 | 367 | 534 | 1745 | 8183 | 0.294 | comparison |
| E9 | 937 | 408 | 594 | 1939 | 9092 | 0.294 | comparison |
| E10 | 1031 | 449 | 653 | 2133 | 10001 | 0.294 | comparison |
| E11 | 1125 | 490 | 712 | 2327 | 10910 | 0.294 | comparison |
| E12 | 1218 | 530 | 772 | 2520 | 11820 | 0.294 | comparison |
| E13 | 1312 | 571 | 831 | 2714 | 12729 | 0.294 | comparison |
| E14 | 1406 | 612 | 890 | 2908 | 13638 | 0.294 | comparison |

Relative Cost per Volume: Developer A:Fixer B:Bleach C is 1.69:1.41:11.68

[a]Total Relative Solution Cost = (Developer Volume * Relative Developer Cost) + (Fixer Volume * Relative Fixer Cost) + (Bleach Volume * Relative Bleach Cost).

TABLE VI

Example 3

| Processes F | Developer A Volume, mL/m$^2$ | Fixer B 1$^{st}$ Volume, mL/m$^2$ | Fixer B 2$^{nd}$ Volume, mL/m$^2$ | Bleach D Volume, mL/m$^2$ | Total Volume, mL/m$^2$ | Total Relative Solution Cost[a] | Bleach Equivalents/ Developer Volume (L) | Comments |
|---|---|---|---|---|---|---|---|---|
| F1 | 187 | 56 | 145 | 278 | 666 | 3649 | 0.689 | |
| F2 | 281 | 84 | 145 | 278 | 788 | 3847 | 0.459 | |
| F3 | 375 | 112 | 145 | 278 | 910 | 4045 | 0.344 | |
| F4 | 469 | 141 | 145 | 278 | 1032 | 4243 | 0.276 | invention |
| F5 | 562 | 169 | 145 | 278 | 1154 | 4441 | 0.230 | invention |
| F6 | 656 | 197 | 145 | 278 | 1275 | 4639 | 0.197 | invention |
| F7 | 750 | 225 | 145 | 278 | 1397 | 4837 | 0.172 | invention |
| F8 | 843 | 253 | 145 | 278 | 1519 | 5035 | 0.153 | invention |
| F9 | 937 | 281 | 145 | 278 | 1641 | 5233 | 0.138 | invention |
| F10 | 1031 | 309 | 145 | 278 | 1763 | 5431 | 0.125 | invention |
| F11 | 1125 | 337 | 145 | 278 | 1885 | 5629 | 0.115 | invention |
| F12 | 1218 | 366 | 145 | 278 | 2006 | 5827 | 0.106 | invention |
| F13 | 1312 | 394 | 145 | 278 | 2128 | 6025 | 0.098 | invention |
| F14 | 1406 | 422 | 145 | 278 | 2250 | 6223 | 0.092 | invention |

Relative Cost per Volume: Developer A:Fixer B:Bleach D is 1.69:1.41:10.98

[a]Total Relative Solution Cost = (Developer Volume * Relative Developer Cost) + (Fixer Volume * Relative Fixer Cost) + (Bleach Volume * Relative Bleach Cost).

Example 4

Using Fixer A and Bleach E (0.6 mol/L bleaching agent), the solution requirements for a series of comparative Processes G are shown in Table VII. These are merged processes, conducted as described in U.S. application Ser. No. 10/012,673 of Twist filed Oct. 30, 2001. Relative costs per unit volume of developer A, fixer A, and bleach E are 1.69, 1.0, and 14.8, respectively, for Processes G. The combined volumes of developer A, fixer A, and bleach E result in a fixing agent (thiosulfate) concentration of 0.75 mol/L and a bleaching agent (Fe(III)PDTA) concentration of 0.12 equivalents/L after developer oxidation for equally rapid processing for each Process G compared to previously described Processes A, C, and E.

Using Fixer A and Bleach F, the solution requirements for a series of inventive Processes H are shown in Table VIII. Relative costs per unit volume of developer A, fixer A, and bleach F are 1.69, 1.0, and 14.1, respectively, for Processes H. The cost of Bleach F used in Processes H is cheaper than the cost of Bleach E used in Processes G, and this contributes to a small extent to some of the cost advantage of Processes H. This is because Processes H do not require Bleach F to contain an acid-providing buffer in order to control the bleach-fixer solution pH. The combined volumes of fixer A and bleach F result in a preferred fixing agent (thiosulfate) concentration of at least 1.0 mol/L and a preferred bleaching agent (Fe(III)PDTA) concentration of at least 0.25 equivalents/L after mixing with about 94 mL/m$^2$ of residual developer/fixer mixture retained in the chamber after solution removal.

When the ratio of the number of bleaching agent equivalents used in the inventive Process H to the volume of developer solution (in liters) is approximately equal to or less than the corresponding ratio for comparative Process G, the inventive Process H is less costly than the comparative Process G that uses the same applied developer volume (compare Process G4 with Process H4, G6 with H6, etc.). Under these more preferred process conditions, this occurs when the ratio of the number of bleaching agent equivalents used in the inventive Process H to the volume of developer solution (in liters). is less than or equal to about 0.25 equivalents of bleaching agent per liter of applied developer solution. The inventive process also uses less total processing solution volume than the comparison process (compare Process G7 with Process H7, etc.), an additional advantage. The advantage of Process H becomes even greater as the applied developer volume is increased further.

TABLE VII

Example 4

| Comparative Processes G | Developer A Volume, mL/m$^2$ | Fixer A Volume, mL/m$^2$ | Bleach E Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| G1 | 187 | 109 | 92 | 388 | 1787 | 0.294 | |
| G2 | 281 | 163 | 138 | 582 | 2680 | 0.294 | |
| G3 | 375 | 217 | 184 | 776 | 3573 | 0.294 | |
| G4 | 469 | 272 | 230 | 970 | 4467 | 0.294 | comparison |
| G5 | 562 | 326 | 276 | 1164 | 5360 | 0.294 | comparison |
| G6 | 656 | 381 | 322 | 1358 | 6253 | 0.294 | comparison |
| G7 | 750 | 435 | 368 | 1553 | 7147 | 0.294 | comparison |
| G8 | 843 | 489 | 414 | 1747 | 8040 | 0.294 | comparison |
| G9 | 937 | 544 | 460 | 1941 | 8933 | 0.294 | comparison |
| G10 | 1031 | 598 | 506 | 2135 | 9827 | 0.294 | comparison |
| G11 | 1125 | 652 | 552 | 2329 | 10720 | 0.294 | comparison |
| G12 | 1218 | 707 | 598 | 2523 | 11613 | 0.294 | comparison |
| G13 | 1312 | 761 | 644 | 2717 | 12507 | 0.294 | comparison |
| G14 | 1406 | 815 | 690 | 2911 | 13400 | 0.294 | comparison |

Relative Cost per Volume: Developer A:Fixer A:Bleach E is 1.69:1.0:14.8
[a]Total Relative Solution Cost = (Developer Volume * Relative Developer Cost) + (Fixer Volume * Relative Fixer Cost) + (Bleach Volume * Relative Bleach Cost).

TABLE VIII

Example 4

| Processes H | Developer A Volume, mL/m$^2$ | Fixer A 1$^{st}$ Volume, mL/m$^2$ | Fixer A 2$^{nd}$ Volume, mL/m$^2$ | Bleach F Volume, mL/m$^2$ | Total Volume, mL/m$^2$ | Total Relative Solution Cost[a] | Bleach Equivalents/ Developer Volume (L) | Comments |
|---|---|---|---|---|---|---|---|---|
| H1 | 187 | 83 | 167 | 186 | 624 | 3192 | 0.596 | |
| H2 | 281 | 125 | 167 | 186 | 759 | 3392 | 0.398 | |
| F3 | 375 | 167 | 167 | 186 | 895 | 3592 | 0.298 | |
| H4 | 469 | 208 | 167 | 186 | 1030 | 3792 | 0.239 | invention |
| H5 | 562 | 250 | 167 | 186 | 1166 | 3992 | 0.199 | invention |
| H6 | 656 | 292 | 167 | 186 | 1301 | 4192 | 0.170 | invention |
| H7 | 750 | 333 | 167 | 186 | 1436 | 4392 | 0.149 | invention |
| H8 | 843 | 375 | 167 | 186 | 1572 | 4592 | 0.133 | invention |
| H9 | 937 | 417 | 167 | 186 | 1707 | 4792 | 0.119 | invention |
| H10 | 1031 | 458 | 167 | 186 | 1842 | 4992 | 0.108 | invention |
| H11 | 1125 | 500 | 167 | 186 | 1978 | 5192 | 0.099 | invention |
| H12 | 1218 | 541 | 167 | 186 | 2113 | 5392 | 0.092 | invention |
| H13 | 1312 | 583 | 167 | 186 | 2249 | 5592 | 0.085 | invention |
| H14 | 1406 | 625 | 167 | 186 | 2384 | 5792 | 0.080 | invention |

Relative Cost per Volume: Developer A:Fixer A:Bleach F is 1.69:1.0:14.1
[a]Total Relative Solution Cost = (Developer Volume * Relative Developer Cost) + (Fixer Volume * Relative Fixer Cost) + (Bleach Volume * Relative Bleach Cost).

Example 5

Using both of the more concentrated Fixer B and Bleach E, the solution requirements for a series of comparative Processes I are shown in Table IX. These are merged processes, conducted as described in U.S. application Ser. No. 10/012,673 of Twist filed Oct. 30, 2001. Relative costs per unit volume of developer A, fixer B, and bleach E are 1.69, 1.41, and 14.8, respectively, for Processes I. The combined volumes of developer A, fixer B, and bleach E result in a fixing agent (thiosulfate) concentration of 0.75 mol/L and a bleaching agent (Fe(III)PDTA) concentration of 0.12 equivalents/L after developer oxidation for equally rapid processing for each Process I compared to the previously described Processes A, C, E, and G.

Using both of the more concentrated Fixer B and Bleach F, the solution requirements for a series of inventive Processes J are shown in Table X. Relative costs per unit volume of developer A, fixer B, and bleach F are 1.69, 1.41, and 14.1, respectively, for Processes J. The combined volumes of fixer B and bleach F result in a preferred fixing agent (thiosulfate) concentration of at least 1.0 mol/L and a preferred bleaching agent (Fe(III)PDTA) concentration of at least 0.25 equivalents/L after mixing with about 94 mL/m$^2$ of residual developer/fixer mixture retained in the chamber after solution removal.

When the ratio of the number of bleaching agent equivalents used in the inventive Process J to the volume of developer solution (in liters) is approximately equal to or less than the corresponding ratio for comparative Process I, the inventive Process J is less costly than the comparative Process I that uses the same applied developer volume (compare Process 14 with Process J4, 16 with J6, etc.). Under these more preferred process conditions, this occurs when the ratio of the number of bleaching agent equivalents used in the inventive Process J to the volume of developer solution (in liters) is less than or equal to about 0.25 equivalents of bleaching agent per liter of applied developer solution. The inventive process also uses less total processing solution volume than the comparison process (compare Process 17 with Process J7, etc.), an additional advantage. The advantage of Process J becomes even greater as the applied developer volume is increased further.

TABLE IX

Example 5

| Comparative Processes I | Developer A Volume, mL/m$^2$ | Fixer B Volume, mL/m$^2$ | Bleach E Volume, mL/m$^2$ | Total Volume, mL/m$^2$ | Total Relative Solution Cost[a] | Bleach Equivalents/ Developer Volume (L) | Comments |
|---|---|---|---|---|---|---|---|
| I1 | 187 | 72 | 83 | 342 | 1644 | 0.265 | |
| I2 | 281 | 108 | 124 | 513 | 2466 | 0.265 | |
| I3 | 375 | 144 | 166 | 684 | 3289 | 0.265 | comparison |
| I4 | 469 | 180 | 207 | 855 | 4111 | 0.265 | comparison |
| I5 | 562 | 216 | 249 | 1026 | 4933 | 0.265 | comparison |
| I6 | 656 | 251 | 290 | 1197 | 5755 | 0.265 | comparison |
| I7 | 750 | 287 | 331 | 1369 | 6577 | 0.265 | comparison |
| I8 | 843 | 323 | 373 | 1540 | 7399 | 0.265 | comparison |
| I9 | 937 | 359 | 414 | 1711 | 8221 | 0.265 | comparison |
| I10 | 1031 | 395 | 456 | 1882 | 9043 | 0.265 | comparison |
| I11 | 1125 | 431 | 497 | 2053 | 9866 | 0.265 | comparison |
| I12 | 1218 | 467 | 539 | 2224 | 10688 | 0.265 | comparison |
| I13 | 1312 | 503 | 580 | 2395 | 11510 | 0.265 | comparison |
| I14 | 1406 | 539 | 621 | 2566 | 12332 | 0.265 | comparison |

Relative Cost per Volume: Developer A:Fixer B:Bleach E is 1.69:1.41:14.8

[a]Total Relative Solution Cost = (Developer Volume * Relative Developer Cost) + (Fixer Volume * Relative Fixer Cost) + (Bleach Volume * Relative Bleach Cost).

TABLE X

Example 5

| Processes J | Developer A Volume, mL/m$^2$ | Fixer B 1$^{st}$ Volume, mL/m$^2$ | Fixer B 2$^{nd}$ Volume, mL/m$^2$ | Bleach F Volume, mL/m$^2$ | Total Volume, mL/m$^2$ | Total Relative Solution Cost[a] | Bleach Equivalents/ Developer Volume (L) | Comments |
|---|---|---|---|---|---|---|---|---|
| J1 | 187 | 56 | 87 | 129 | 459 | 2336 | 0.413 | |
| J2 | 281 | 84 | 87 | 129 | 581 | 2534 | 0.275 | |
| J3 | 375 | 112 | 87 | 129 | 703 | 2732 | 0.206 | invention |
| J4 | 469 | 141 | 87 | 129 | 825 | 2930 | 0.165 | invention |
| J5 | 562 | 169 | 87 | 129 | 947 | 3128 | 0.138 | invention |
| J6 | 656 | 197 | 87 | 129 | 1069 | 3326 | 0.118 | invention |
| J7 | 750 | 225 | 87 | 129 | 1190 | 3524 | 0.103 | invention |
| J8 | 843 | 253 | 87 | 129 | 1312 | 3722 | 0.092 | invention |
| J9 | 937 | 281 | 87 | 129 | 1434 | 3920 | 0.083 | invention |
| J10 | 1031 | 309 | 87 | 129 | 1556 | 4118 | 0.075 | invention |
| J11 | 1125 | 337 | 87 | 129 | 1678 | 4316 | 0.069 | invention |
| J12 | 1218 | 366 | 87 | 129 | 1800 | 4514 | 0.064 | invention |
| J13 | 1312 | 394 | 87 | 129 | 1921 | 4712 | 0.059 | invention |
| J14 | 1406 | 422 | 87 | 129 | 2043 | 4910 | 0.055 | invention |

Relative Cost per Volume: Developer A:Fixer B:Bleach F is 1.69:1.41:14.1

[a]Total Relative Solution Cost = (Developer Volume * Relative Developer Cost) + (Fixer Volume * Relative Fixer Cost) + (Bleach Volume * Relative Bleach Cost).

EXAMPLE 6

Example 6 of the Inventive Process

One 36-exposure roll each of KODAK Max 800 Zoom 35mm film and Konica Centuria 800 35mm film was suitably exposed to light through a variable density test object and then loaded and processed singly in the processing chamber of a processor as described in U.S. application Ser. No. 09/920,495 of Twist et al filed Aug. 1, 2001. The chamber and its environment were heated to 54.40C before the films were loaded and processed. Processing of each of the films was conducted as follows:

Developer A at 54.4°C. was added all at once to the stationary chamber in the amount of 1406 mL/m$^2$ of film. Film was not present in the region of the processing chamber to which the developer was added. Rotation of the chamber at 30 rpm was then begun in order to apply the developer to the entire surface of the film. After developing for 60 seconds, Fixer A at 54.4°C. was added to the processing chamber containing the film and developer. The fixer was added all at once in the amount of 562 mL/m$^2$ of film while continuing to rotate the chamber at 30 rpm. This stopped development and initiated fixing. After 10 seconds, rotation of the chamber was stopped and the mixture of Developer A and Fixer A was removed from the processing chamber by suction.

Then, another volume of Fixer A at 54.4° C. was added all at once to the stationary processing chamber in the amount of 375 mL/m$^2$ of film to continue fixing of the film. Immediately thereafter, Bleach D at 54.4°C. was added all at once to the stationary processing chamber in the amount of 544 mL/m of film to bleach the developed silver. The chamber was then rotated at 30 rpm, and bleach-fixing was conducted for 70 seconds after which the rotation of the processing chamber was stopped and the mixture of Fixer A and Bleach D was removed from the chamber by suction. The film was then rinsed four times with water at 54.4° C. Each application of water was in the amount of 1125 mL/m$^2$ of film. Each rinse stage consisted of adding the water volume to the stationary processing chamber, rotating the processing chamber at 30 rpm for 10 seconds, stopping the rotation of the chamber, and removing the solution by suction. The film was then dried in warm air. A useful image was obtained as shown below and silver was satisfactorily removed from the film. Red, green, and blue Status M image densities were measured for each exposure level (step number) of the film and these densities are tabulated below for each film.

KODAK Max 800 Zoom Film

| | Status M Density | | |
|---|---|---|---|
| Step Number | Red | Green | Blue |
| 1 (D-max) | 1.54 | 2.65 | 3.13 |
| 2 | 1.46 | 2.53 | 2.97 |
| 3 | 1.4 | 2.41 | 2.86 |
| 4 | 1.32 | 2.26 | 2.7 |
| 5 | 1.24 | 2.13 | 2.52 |
| 6 | 1.16 | 1.98 | 2.31 |
| 7 | 1.05 | 1.83 | 2.13 |
| 8 | 0.97 | 1.7 | 1.98 |
| 9 | 0.87 | 1.56 | 1.83 |
| 10 | 0.77 | 1.4 | 1.68 |
| 11 | 0.67 | 1.26 | 1.54 |
| 12 | 0.58 | 1.14 | 1.41 |
| 13 | 0.5 | 1.02 | 1.3 |
| 14 | 0.45 | 0.93 | 1.21 |
| 15 | 0.42 | 0.87 | 1.16 |
| 16 | 0.4 | 0.84 | 1.13 |
| 17 | 0.39 | 0.82 | 1.11 |
| 18 | 0.39 | 0.81 | 1.1 |
| 19 | 0.39 | 0.81 | 1.1 |
| 20 | 0.4 | 0.82 | 1.12 |
| 21 (D-min) | 0.39 | 0.81 | 1.11 |

KONICA Centuria 800 Film

| | Status M Density | | |
|---|---|---|---|
| Step Number | Red | Green | Blue |
| 1 (D-max) | 1.7 | 2.3 | 2.89 |
| 2 | 1.6 | 2.19 | 2.73 |
| 3 | 1.5 | 2.08 | 2.56 |
| 4 | 1.37 | 1.95 | 2.38 |
| 5 | 1.25 | 1.83 | 2.24 |
| 6 | 1.12 | 1.7 | 2.09 |
| 7 | 0.99 | 1.58 | 1.95 |
| 8 | 0.89 | 1.48 | 1.84 |
| 9 | 0.79 | 1.38 | 1.73 |
| 10 | 0.69 | 1.29 | 1.6 |
| 11 | 0.59 | 1.19 | 1.47 |
| 12 | 0.49 | 1.1 | 1.34 |
| 13 | 0.41 | 0.99 | 1.23 |
| 14 | 0.37 | 0.92 | 1.16 |

-continued

KONICA Centuria 800 Film

| | Status M Density | | |
|---|---|---|---|
| Step Number | Red | Green | Blue |
| 15 | 0.35 | 0.9 | 1.14 |
| 16 | 0.34 | 0.88 | 1.12 |
| 17 | 0.33 | 0.88 | 1.11 |
| 18 | 0.33 | 0.88 | 1.11 |
| 19 | 0.33 | 0.88 | 1.11 |
| 20 | 0.33 | 0.88 | 1.11 |
| 21 (D-min) | 0.33 | 0.88 | 1.11 |

The solution volumes used in this process were slightly less than those for Process Dl0 in Table IV. A slightly smaller 1$^{St}$ volume of Fixer A, a smaller 2$^{nd}$ volume of Fixer A, and a smaller volume of Bleach D were used. So this process consumed less processing solution at less cost than Process D10, which is inventive. The ratio of the number of bleaching agent equivalents used in the inventive Process D10 to the volume of developer solution (in liters) was equal to 0.18 equivalents of bleaching agent per liter of applied developer solution

| Component | |
|---|---|
| **Developer A Formulation** | |
| Sodium Sulfite | 6.0 g/L |
| Sodium Bromide | 2.1 g/L |
| Hydroxylamine Sulfate | 1.0 g/L |
| Diethylenetriaminepentaacetic acid, pentasodium salt (40% w/w solution) | 3.6 g/L |
| Sodium Carbonate, monohydrate | 26.9 g/L |
| Polyvinylpyrrolidinone K-15 | 2.4 g/L |
| 4-(N-ethyl-N-(β-hydroxyethyl)-amino)-2-methylaniline sulfate | 6.75 g/L |
| pH (adj with NaOH or $H_2SO_4$) | 10.1 |
| **Fixer A Formulation** | |
| Ammonium Thiosulfate Solution (56% w/w ammonium thiosulfate, 4% w/w ammonium sulfite) | 525 mL/L |
| Sodium Metabisulfite | 7.8 g/L |
| Succinic acid | 12 g/L |
| pH (adjust with succinic acid and ammonium hydroxide) | 5.75 |
| **Fixer B Formulation** | |
| Ammonium Thiosulfate Solution (56% w/w ammonium thiosulfate, 4% w/w ammonium sulfite) | 700 mL/L |
| Sodium Metabisulfite | 16.4 g/L |
| Succinic acid | 18.4 g/L |
| pH (adjust with succinic acid and ammonium hydroxide) | 5.75 |
| **Bleach A Formulation** | |
| 1,3-Diaminopropanetetraacetic acid | 105.9 g/L |
| Ferric Nitrate, 9 Hydrate | 127 g/L |
| Ammonium hydroxide (28%) to dissolve the above ingredients | approx. 101 mL/L |
| Succinic Acid | 30 g/L |
| Sulfuric acid and Water to give a volume of 1 L and pH of | |
| pH | 4.1 |
| **Bleach B Formulation** | |
| 1,3-Diaminopropanetetraacetic acid | 105.9 g/L |
| Ferric Nitrate, 9 Hydrate | 127 g/L |
| Ammonium hydroxide (28%) to dissolve the above ingredients | approx. 101 mL/L |
| Sulfuric acid and Water to give a volume of 1 L and pH of | |
| pH | 5.9 |

-continued

| Component | |
|---|---|
| **Bleach C Formulation** | |
| 1,3-Diaminopropanetetraacetic acid | 156.8 g/L |
| Ferric Nitrate, 9 Hydrate | 188 g/L |
| Ammonium hydroxide (28%) to dissolve the above ingredients | approx. 150 mL/L |
| Succinic Acid | 30 g/L |
| Sulfuric acid and Water to give a volume of 1 L and pH of | |
| pH | 4.1 |
| **Bleach D Formulation** | |
| 1,3-Diaminopropanetetraacetic acid | 156.8 g/L |
| Ferric Nitrate, 9 Hydrate | 188 g/L |
| Ammonium hydroxide (28%) to dissolve the above | approx. 150 mL/L |
| **Bleach E Formulation** | |
| 1,3-Diaminopropanetetraacetic acid | 202 g/L |
| Ferric Nitrate, 9 Hydrate | 242.6 g/L |
| Ammonium hydroxide (28%) to dissolve the above ingredients | approx. 194 mL/L |
| Succinic Acid | 30 g/L |
| Sulfuric acid and Water to give a volume of 1 L and pH of | |
| pH | 4.1 |
| **Bleach F Formulation** | |
| 1,3-Diaminopropanetetraacetic acid | 202 g/L |
| Ferric Nitrate, 9 Hydrate | 242.6 g/L |
| Ammonium hydroxide (28%) to dissolve the above ingredients | approx. 194 mL/L |
| Sulfuric acid and Water to give a volume of 1 L and pH of | |
| pH | 5.9 |

The invention has been described in detail with particular reference to certain preferred embodiments thereof, but it will be understood that variations and modifications can be effected within the spirit and scope of the invention.

What is claimed is:

1. A method for processing a silver halide color photographic material comprising the steps of loading the material into a chamber adapted to hold the material therein; introducing a measured amount of a color developer solution into the chamber; developing the photographic material with the color developer solution; introducing into the chamber a measured amount of a processing solution which arrests development, without removing the color developer solution, to form a developer/stop solution mixture; processing the photographic material with the developer/stop solution mixture, substantially removing all of the developer/stop mixture solution from the chamber; then providing in the chamber a bleach/fixer solution mixture comprising a bleaching agent and a fixing agent; and processing the photographic material with the bleach/fixer solution mixture; wherein the color developer solution is utilized in the amount of greater than or equal to 375 ml/m$^2$ of the photographic material that is processed; and wherein the total volume of solution or solution mixture for each processing stage is spread over the whole area of the photographic material in a repetitive manner to enable uniform processing.

2. The method of claim 1 wherein the color developer solution is utilized in the amount of greater than or equal to 470 ml/m$^2$ of photographic material that is processed.

3. The method of claim 1 wherein the color developer solution is utilized in the amount of greater than or equal to 850 ml/m$^2$ of photographic material that is processed.

4. The method of claim 1 wherein the color developer solution is utilized in the amount of greater than or equal to 1200 ml/m$^2$ of photographic material that is processed.

5. The method of claim 1 wherein the ratio of the bleaching agent equivalents utilized in the process to the volume of color developer solution utilized in the process, in liters, is less than or equal to 0.48.

6. The method of claim 1 wherein the ratio of the bleaching agent equivalents utilized in the process to the volume of color developer solution utilized in the process, in liters, is less than or equal to 0.33.

7. The method of claim 1 wherein the ratio of the bleaching agent equivalents utilized in the process to the volume of color developer solution utilized in the process, in liters, is less than or equal to 0.25.

8. The method of claim 1 wherein the bleach/fixer solution mixture is provided by combining a measured amount of a bleach solution and a measured amount of a fixer solution prior to introducing them into the chamber.

9. The method of claim 1 wherein the bleach/fixer solution mixture is provided by introducing separately into the chamber a measured amount of a fixer solution and a measured amount of a bleach solution.

10. The method of claim 9 wherein the bleach solution is introduced into the chamber before the fixer solution.

11. The method of claim 9 wherein the fixer solution is introduced into the chamber before the bleach solution.

12. The method of claim 9 wherein the fixer solution and the bleach solution are introduced into the chamber simultaneously.

13. The method of claim 1 wherein the bleach/fiker solution mixture is provided by introducing a measured amount of a pre-prepared bleach/fixer solution.

14. The method of claim 13 wherein the pre-prepared bleach/fixer solution and a measured amount of a bleach solution are introduced into the chamber.

15. The method of claim 14 wherein the bleach solution is introduced into the chamber before the pre-prepared bleach/fixer solution.

16. The method of claim 14 wherein the pre-prepared bleach/fixer solution is introduced into the chamber before the bleach solution.

17. The method of claim 14 wherein the pre-prepared bleach/fixer solution and the bleach solution are introduced into the chamber simultaneously.

18. The method of claim 1 wherein the pre-prepared bleach/fixer solution and a measured amount of a fixer solution are introduced into the chamber.

19. The method of claim 18 wherein the fixer solution is introduced into the chamber before the pre-prepared bleach/fixer solution.

20. The method of claim 18 wherein the pre-prepared bleach/fixer solution is introduced into the chamber before the fixer solution.

21. The method of claim 18 wherein the pre-prepared bleach/fixer solution and the fixer solution are introduced into the chamber simultaneously.

22. The method of claim 1 wherein the solution that arrests development is a fixer solution.

23. The method of claim 1 wherein the solution that arrests development is an acidic stop solution.

24. The method of claim 1 wherein the fixing agent is a thiosulfate fixing agent.

25. The method of claim 1 wherein the bleaching agent is a ferric chelate bleaching agent.

26. The method of claim 25 wherein the ferric chelate bleaching agent is one or more of a ferric complex of ethylenediaminetetraacetic acid, 1,3-propanediamine-N,N,N',N'-tetraacetic acid, ethylenediamine-N-(2-carboxyphenyl)-N,N',N'-triacetic acid, ethylenediaminedisuccinic acid (particularly the S,S-isomer), ethylenediaminemonosuccinic acid, N-(2-carboxyethyl) aspartic acid, or N-methyliminodiacetic acid.

27. The method of claim 1 wherein the photographic material is processed with the developer/stop solution mixture for 30 seconds or less.

28. The method of claim 1 wherein the photographic material is processed with the color developer solution for 100 seconds or less.

29. The method of claim 1 wherein the photographic material is processed with the bleach/fixer solution mixture for 120 seconds or less.

30. The method of claim 1 wherein the photographic material is processed with the bleach/fixer solution mixture at a pH between 4.5 and 6.5.

31. The method of claim 1 wherein the bleach/fixer solution mixture has a bleaching agent concentration between 0.2 and 0.6 equivalents per liter.

32. The method of claim 1 the bleach/fixer solution mixture has a fixing agent concentration between 0.75 and 2.0 mol/L.

33. The method of claim 1 wherein the color developer solution contains a para-phenylenediamine color developing agent.

34. The method of claim 1 wherein the entire process is carried out at a temperature of 35 to 60° C.

35. The method of claim 1 wherein the entire process is carried out at a temperature of greater than 40° C.

36. The method of claim 1 wherein the silver halide photographic material is a color negative film.

37. A method for processing a silver halide color negative film comprising the steps of loading the film into a chamber adapted to hold the film therein, introducing a measured amount of a color developer solution containing a para-phenylenediamine developing agent into the chamber; developing the film with the color developer solution for 100 seconds or less; introducing into the chamber a measured amount of a processing solution which arrests development, without removing the color developer solution, to form a developer/stop solution mixture; processing the photographic material with the developer/stop solution mixture for 30 seconds or less; substantially removing all of the developer/stop solution mixture from the chamber; then introducing into the chamber a measured amount of a bleach solution containing a ferric chelate bleaching agent and a measured amount of a fixer solution containing a thiosulfate fixing agent to provide a bleach/fixer solution mixture; and processing the film with the bleach/fixer solution mixture for 120 seconds or less; wherein the color developer solution is utilized in the amount of greater than or equal to 375 ml/m$^2$ of the color negative film that is processed and wherein the ratio of the bleaching agent equivalents utilized in the process to the volume of color developer solution utilized in the process, in liters, is less than or equal to 0.48; and wherein the total volume of solution or solution mixture for each processing stage is spread over the whole area of the film in a repetitive manner to enable uniform processing and the entire process is carried out at a temperature of 35 to 60° Centigrade.

38. The method of claim 37 wherein the color developer solution is utilized in the amount of greater than or equal to 850 ml/m$^2$ of photographic material that is processed.

39. The method of claim 37 wherein the color developer solution is utilized in the amount of greater than or equal to 1200 ml/m$^2$ of photographic material that is processed.

* * * * *